United States Patent [19]

Feil

[11] 4,378,542

[45] Mar. 29, 1983

[54] ELECTROMAGNETIC CONTACTOR

[75] Inventor: Paul G. Feil, Evansville, Ind.

[73] Assignee: AMF Inc., White Plains, N.Y.

[21] Appl. No.: 317,021

[22] Filed: Oct. 30, 1981

[51] Int. Cl.[3] ..... H01H 51/08

[52] U.S. Cl. ..... 335/132; 335/126; 335/131

[58] Field of Search ..... 335/132, 131, 126, 261, 335/260, 188, 203

[56] References Cited

U.S. PATENT DOCUMENTS

| | | | |
|---|---|---|---|
| 2,414,961 | 1/1947 | Mason et al. | 335/261 |
| 2,782,282 | 2/1957 | Schrack | 335/131 |
| 3,278,874 | 10/1966 | Fecho et al. | 335/260 |
| 3,327,264 | 6/1967 | Rodaway | 335/188 |
| 3,444,490 | 5/1969 | Krummel et al. | 335/126 |
| 3,451,018 | 6/1969 | Di Marco | 335/131 |
| 3,651,437 | 3/1972 | Kiyoshi | 335/131 |
| 3,815,060 | 6/1974 | Turnbull | 335/131 |
| 4,003,011 | 1/1977 | Hayden | 335/131 |

*Primary Examiner*—Harold Broome

*Attorney, Agent, or Firm*—David E. Dougherty; Charles J. Worth

[57] ABSTRACT

An electromagnetic contactor having a box shaped frame DC solenoid, a plunger with one end attached to a stamped metal bracket which, in turn, is attached to a pusher assembly. The pusher assembly includes the movable contacts. As the solenoid plunger is extended and retracted, the contacts associated with the assembly will engage and disengage in response thereto. The solenoid is mounted in a base and is biased up against the carrier by a curved spring washer. The coil terminals are part of the solenoid and are trapped or contained between guide walls of the base to provide strain relief. The coil terminals are not rigidly attached to the base so as to allow the solenoid to float and to prevent fatigue of the terminals.

9 Claims, 10 Drawing Figures

ELECTROMAGNETIC CONTACTOR

FIELD OF THE INVENTION

The invention relates to magnetic switching devices and, more particularly, to magnetic contactors and to plunger solenoid assemblies useful in such contactors.

BACKGROUND OF THE INVENTION

In electromagnetically actuated circuit controlling devices such as contactors, among the prime considerations is their reliable operation, rugged construction, and ease of assembly. Still other important considerations are ease of inspection and replacement of the components of the contactor and particularly of the contacts and coil.

In a number of prior art devices, such as described in U.S. Pat. No. 2,414,961 issued Jan. 28, 1947 to Charles R. Mason et al, an armature and movable contact mounting are provided having two springs, one to bias the armature to the unattracted or circuit open position and the other to permit relative movement between the contacts and the armature after the contact has reached the closed circuit position during the movement of the armature to the attracted position. The armature is fixed to the bridging contact assembly by means of a screw which extends from the contact assembly and is threaded into the armature.

Other prior art devices of interest are shown in U.S. Pat. Nos. 2,294,685 issued Feb. 9, 1960 to Burch; 2,999,192 issued Sept. 5, 1961 to Lambert; 3,130,284 issued Apr. 21, 1964 to Woods; 3,265,828 issued Aug. 9, 1966 to Corn; 3,278,874 issued Oct. 11, 1966 to Fecho et al; 3,327,264 issued June 20, 1967 issued to Rodaway; 3,444,490 issued May 13, 1969 to Krummel et al, 3,614,680 issued Oct. 19, 1971 to Haydu; 4,044,322 issued Aug. 23, 1977 to Brown et al and 4,124,169 issued Feb. 27, 1979 to Katchka et al.

These patents are mentioned as being representative of the prior art and other pertinent references may exist. None of the above noted patents are deemed to affect the patentability of the present claimed invention.

In contrast to the prior art, the present invention provides an electromagnetic contactor having the combination of components and structual features including: a movable pusher assembly having a stamped metal bracket attached to the bottom portion thereof, said metal bracket having a slot formed in a raised portion to define a plunger head receiving alcove between the pusher and the raised portion of the bracket, a plunger having a head portion with an intermediate neck portion of reduced diameter between the head portion and the body portion of the plunger, said neck being adapted to fit between the end walls of the slot in said bracket for trap mounting the head portion between the pusher and bracket members, a box shaped frame DC solenoid mounted in a base container and biased up against a carrier by a curved washer shaped spring member whereby the solenoid is float mounted to prevent component fatigue and accommodate for tolerance accumulations in the solenoid and base and to absorb the shock when the plunger seats.

SUMMARY OF THE INVENTION

An electromagnetic solenoid contactor (10) comprising:

a housing (18) formed of insulating material and having a cavity therein;

a solenoid coil and frame assembly (15) having an axial bore opening (58)

biasing means (17) for supportively mounting the solenoid coil assembly (15) within said cavity;

a stationary contact block (11) of insulating material mounted on said housing (18) and having a stationary contact, and having a pusher guide channel (57);

a pusher (23) slidably mounted in the pusher guide channel (57), and having a contact (25) movable therewith disposed for being engaged and disengaged with said stationary contact (24) with upward and downward movement of the pusher;

a metal bracket (12) affixed to and movable with said pusher, and having a contoured portion (31) with a slot (32) therein defining an alcove (35) between a portion of the bracket and said pusher;

an elongate plunger (13) formed of magnetic material and having a first portion adapted for being slidably received within said axial bore opening of the solenoid coil, and having an intermediate section (42) adapted for being received within said slot in the bracket, and having an end portion (43) trap mounted within sad alcove for movement with said pusher; and biasing means (14) for urging the pusher in a direction wherein the pusher contact is disengaged from the stationary contact with said solenoid coil being deenergized.

Accordingly, it is an object of the present invention to provide a new and improved contactor.

Another object of the present invention is to provide an improved plunger mounting assembly with the pusher.

Another object of the present invention is to provide a novel bracket arrangement for the plunger of an electromagnetic relay or contactor.

Another object of the present invention is to provide a new and improved mounting arrangement for the solenoid coil assembly.

Another object of the present invention is to provide a novel mounting for the coil terminals.

Another object of the present invention is to provide a new and improved spring washer for float mounting the solenoid coil assembly.

BRIEF DESCRIPTION OF THE DRAWINGS

Other objects and advantages of the invention may be more clearly seen when viewed in conjunction with the accompanying drawings. Similar reference numerals refer to similar parts throughout.

DETAILED DESCRIPTION OF THE INVENTION

Figure 1:
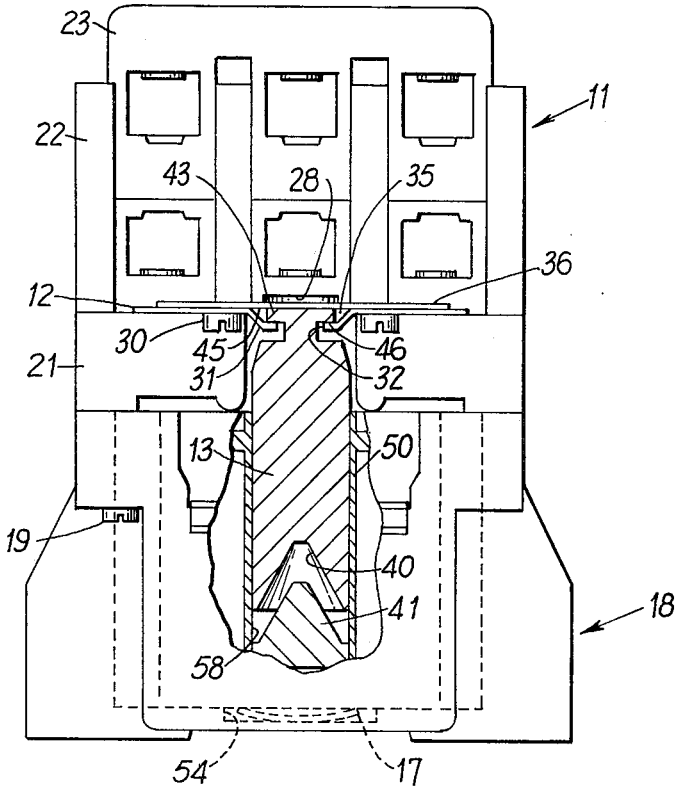
FIG. 1 is a side view partly cut-away illustrating the plunger assembly in accordance with the invention.
Figure 2:
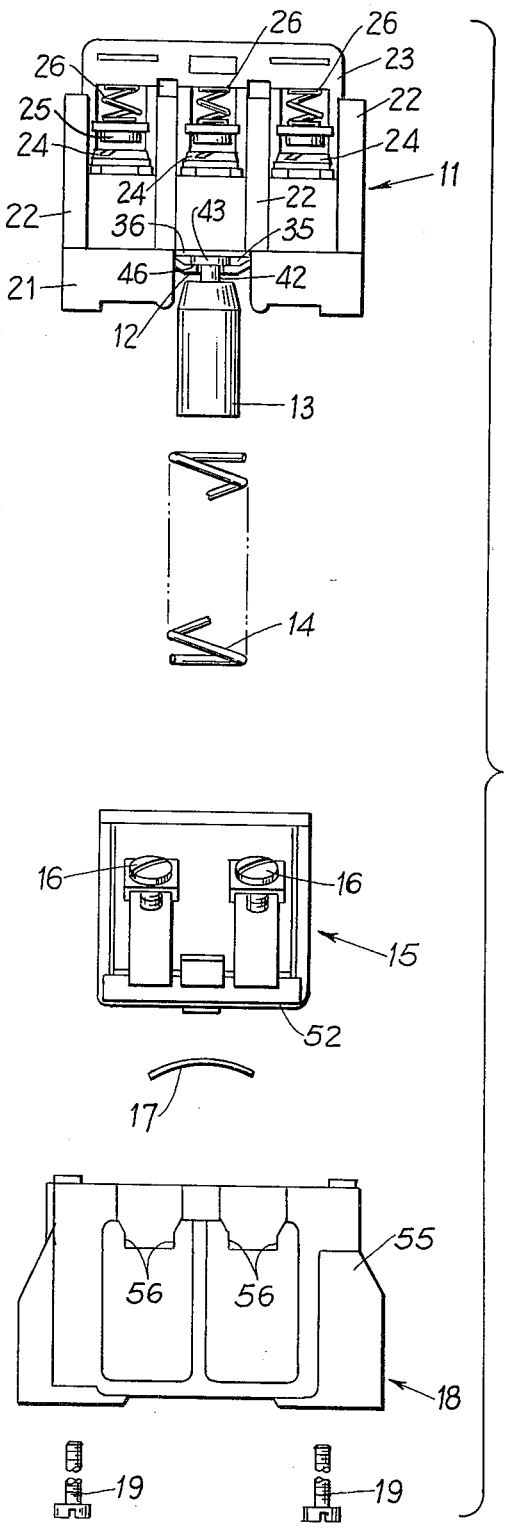
FIG. 2 is an exploded view of the contactor shown in FIG. 1.
Figure 4:
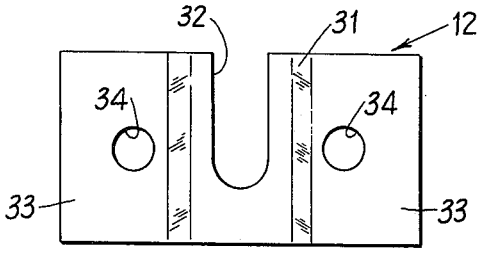
FIGS. 4 and 4*a* are top and side views of the plunger mounting bracket, respectively.
Figure 4A:
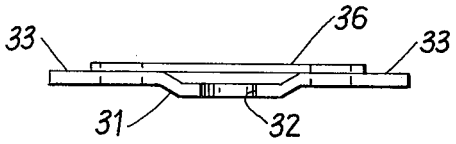

Referring now to FIGS. 1 and 2, a solenoid accuated contactor or relay 10 is shown comprising a pusher assembly 11, a metal plunger bracket 12, a plunger 13, a return spring 14, a solenoid coil and frame assembly 15 having fixed terminals 16, a curved spring washer shaped support spring 17 for the solenoid coil assembly 15 and lower housing member 18 secured to the pusher assembly 11 by screws 19, with the contactor 10 in the assembled state.

Figure 3:
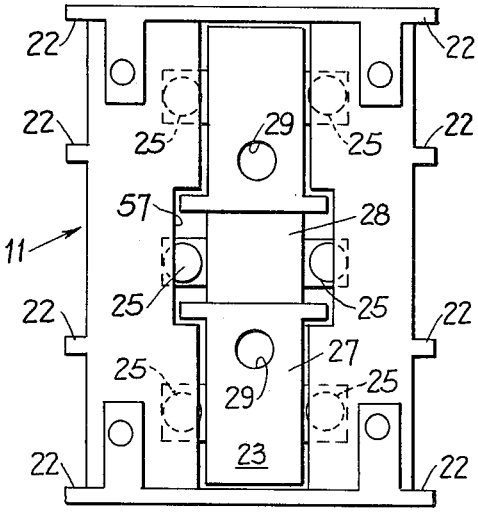
FIG. 3 is a bottom view of the upwardly and downwardly movable pusher and the pusher assembly shown without the bracket assembly.
Figure 5:
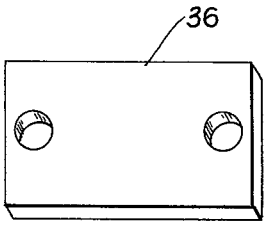
FIG. 5 is a perspective view of a rubber pad.

With reference now to FIGS. 1, 2 and 3, the carrier assembly 11 generally comprises a base member 21 having an elongate rectangular aperture 57 and upward standing partition walls 22, and a movable contact carrying pusher 23 upwardly and downwardly mounted in said aperture. The base member 21 includes a plurality of stationary contacts 24 interposed between the partition walls 22. The movable pusher 23 is dimensioned to slidably fit in the base aperture and contains a plurality of movable contacts. Each movable contact 25 is aligned for being biased, by means of respective helical springs, into engagement with a respective stationary contact 24 with the pusher 23 disposed downwardly in the contactor actuated state. The bottom surface (see FIG. 3) of the movable pusher 23 includes two spaced bracket mounting platform surfaces 27 with a recessed bridging member 28 interposed therebetween. Each mounting surface has a screw hole 29 formed therein for receiving a plunger bracket mounting screw 30 therein.

With reference now to FIGS. 1–5, the stamped metal plunger bracket 12 is generally of rectangular shape having central bent portion 31 which contains a slot 32. Each side mounting surface 33 contains a screw hole 34 for receiving a respective self tapping screw 30 which grips the side walls of the respective pusher mounting hole 29. With the movable pusher member 23 slidably mounted in the aperture of the carrier 11, the plunger bracket 12 is attached thereto, by means of screws 30, such that bent portion 31 projects in a downward direction to establish an alcove 35 between bent portion 31 and the recessed end wall 28 of pusher 23. A rubberized or resilient gasket or sheet member 36 may be sandwiched between pusher 23 and plunger bracket 12 to establish a yieldable or spring like sheet surface spanning or stretched across the flat surfaces 33 of bracket 12 thereby separating the alcove 35 into two regions. The dimensions, particularly the width, of the plunger bracket 12 are selected to extend beyond the edges of the aperture in the pusher base 21 whereby the movable contact carrying pusher member 23 is prevented from being upwardly dislodged or removed from the pusher base 21.

The plunger 13 is formed of magnetic metal and has a generally cylindrical or elongate round bar shape. A stop means is associated with one end of the plunger 13 for providing magnetic attraction and a stop in response to the energization of the solenoid. The stop means is shaped in the form of a conical recess 40 in the bottom end of plunger 13, which engages with a cone shaped stop 41 at the base of the bobbin for providing the means for attracting and stopping the plunger 13. The other end of the plunger 13 is distinguished by a neck portion 42 of reduced diameter and a crown or head portion 43. The neck portion 42 is sized to loosely fit between the end walls of bracket 12 which defines slot 32. The head portion 43 is dimensioned to extend beyond the end walls of slot 32 thereby trapping the head portion 43 between the metal bracket 12 and the recessed surface wall 28 of pusher 23. The head portion 43 is further selected to have a thickness greater than the spacing between the lower surface 45 of sheet member 36 and the inner surface 46 of bracket 12 such that the plunger head portion 43 is yieldably urged against bracket 12. In this manner, the plunger head portion 43 is loosely confined in alcove 35, between bracket 12 and sheet member 36, in a rotatable and rockable disposition so as to enable rotational and/or rocking motion of the plunger 13 to prevent or reduce any possible binding of the plunger 13 as it is extended into and retracted from the bobbin.

Figure 6:
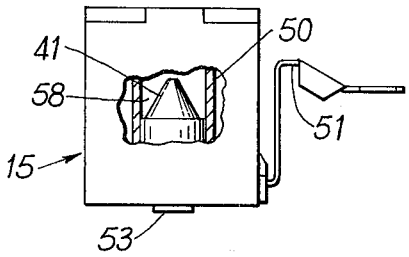
FIG. 6 is a partly cut-away side view of the solenoid or motor assembly.

With reference now to FIGS. 1, 2 and 6, the solenoid coil assembly 15 comprises a discrete or modular unit having a bobbin 50 with a plunger exciting coil wound therearound (not shown) with each of its coil end leads connected to a respective fixed contoured metal terminal 16. The terminals 16 have a bent portion 51 adapted to loosely fit over the side walls of the lower housing member 18 to permit the solenoid coil assembly 15 to flex or move in an upward and downward direction when float mounted in housing member 18. A cone shaped stop 41 is attached to the base wall 52 of coil and frame assembly 15, for example, by staking 53.

Figure 8:
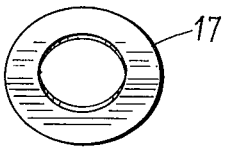
FIGS. 8 and 8*a* are top and side views of the curved spring washer.
Figure 8A:
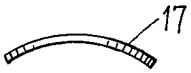
Figure 7:
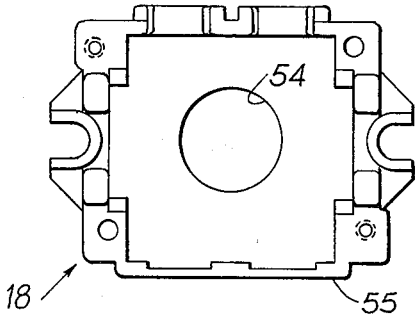
FIG. 7 is a top view of the base or solenoid housing shown in FIG. 2.

As seen from FIGS. 1, 2 and 7, the lower housing member 18 is generally box shaped and open at the top. A recess or circular alcove 54 is provided in the interior bottom wall surface of housing member 18 for receiving the curved spring washer 17 therein. Side wall 55 includes two terminal cut-outs defining guide walls 56 for receiving a respective terminal 16 therebetween. The housing member 18 is designed to loosely accommodate the solenoid coil assembly 15 therein supportably mounted on the curved spring washer 17 (FIGS. 8 and 8*a*) with the terminal(s) neck portion(s) 51 disposed or trapped between guide walls 56. In this manner, the solenoid coil assembly and terminals are somewhat float mounted and generally biased upward, by spring washer 17, in a direction toward the carrier assembly 11 against stop 59 whereby any tolerance accumulation in the solenoid and base are compensated for and plunger seating shock is accommodated.

While the invention has been described with respect to a preferred embodiment, it should be apparent to those skilled in the art that modification may be made thereto without departing from the spirit and scope of the invention.

I claim:

1. An electromagnetic solenoid contactor comprising:

a housing formed of insulating material and having a cavity therein;

a solenoid coil having an axial bore opening;

biasing means for supportively mounting the solenoid coil within said cavity;

a stationary contact block of insulating material mounted on said housing, and having a stationary contact, and having a pusher guide channel;

a pusher slidably mounted in the pusher guide channel, and having a contact movable therewith disposed for being engaged and disengaged with said stationary contact with upward and downward movement of the pusher;

a metal bracket affixed to and movable with said pusher, and having a portion with an aperture therein defining an alcove between a portion of the bracket and said pusher;

an elongate plunger formed of magnetic material and having a first portion adapted for being slidably received within said axial bore opening of the solenoid coil, and having an intermediate section adapted for being received within said aperture in the bracket, and having an end portion trap mounted within said alcove for movement with said pusher; and biasing means for urging the pusher in a direction wherein the pusher contact is disengaged from the stationary contact with said solenoid coil being deenergized.

2. A contactor as in claim 1, wherein:

the metal bracket has portions which extend past the wall portions of the stationary contact block defining the pusher guide channel whereby said pusher is secured from being dislodged upwardly without the stationary contact block.

3. A contactor as in claim 1, wherein:

the pusher has a bottom surface portion with two spaced planar bracket mounting portions having a recess portion interposed therebetween.

4. A contactor as in claim 3, wherein:

the metal bracket has two spaced planar portions each affixed to a respective planar bracket mounting portion of said pusher, and having said aperture generally aligned with the axial bore opening.

5. A contactor as in claim 4, wherein:

a sheet formed of elastic material is interposed between a portion of said pusher and said metal bracket.

6. A contactor as in claim 1, wherein:

the pusher has a bottom surface portion having two spaced apart planar surface portions with a recessed intermediate surface portion therebetween;

the metal bracket has two spaced planar surface portions each being aligned with and secured to a planar surface portion of said pusher, and having an intermediate section contoured to extend downward in the direction of said solenoid coil and having a slot generally aligned with the axial bore opening; and a resilient sheet means disposed between said metal bracket and the pusher whereby said alcove is partitioned to form an upper and a lower alcove.

7. A contactor as in claim 6, wherein:

the plunger includes a body portion dimensioned to fit within the axial bore opening, a neck portion dimensioned to loosely fit in the bracket slot, and a generally circular shaped crown portion extending from the end of the neck portion to snugly fit within said lower alcove between said bracket and the resilient sheet means, said crown portion having a diameter greater than the slot in the bracket whereby the plunger is rockably and revolvingly trap mounted to the pusher.

8. A contactor as in claim 1, wherein;

the housing includes a side wall having two terminal guide channels;

the solenoid is contained in a box shaped housing and has two coil terminals rigidly affixed thereto each having a portion contoured to fit within a respective guide channel of the housing; and the biasing means for supporting said solenoid coil comprises a curved washer shaped spring disposed between the bottom wall of the housing and the box shaped solenoid housing to substantially float mount the solenoid within the housing cavity.

9. An electromagnetic DC solenoid device comprising:

a generally box shaped housing formed of electrical insulative plastic having an open top end, and having a side wall with two slots each forming a terminal guide channel, and a circular recess at the inner surface of a bottom wall;

a solenoid coil assembly having a coil wound around a bobbin with an axial bore therein, said solenoid coil and bobbin being confined in a container open at one end of the axial bore, and having a cone shaped stop affixed within the other end of the axial bore, and having two stamped metal terminals each rigidly mounted to said solenoid coil assembly and being contoured to have a portion movably received within a respective guide channel with a terminal end without said housing;

a stationary contact block of insulative material having a stationary contact support wall with a pusher guide passageway therein, and having a plurality of stationary contacts each mounted on the support wall adjacent the pusher guide passageway;

a curved washer shaped spring means disposed in said circular recess in the housing for float mounting the solenoid coil assembly within the interior space of the housing;

a pusher upwardly and downwardly movably disposed in the pusher guide passageway with a top end portion extending above and a bottom end portion extending below the stationary contact support wall, said bottom end portion having a plunger receiving slot, and having a plurality of movable contacts each aligned with a stationary contact for engaging and disengaging therewith with upward and downward movement of the pusher;

a generally rectangular stamped metal bracket with an aperture formed in a bent portion which projects downward in a direction toward the solenoid coil assembly to define a cavity between the pusher and the bracket with the aperture generally aligned with the axial bore of the solenoid coil assembly;

an elongate bar shaped plunger of magnetic material with a first portion dimensioned to fit within the axial bore, and having a resilient sheet means in said cavity;

an elongate bar shaped plunger of magnetic material with a first portion dimensioned to be received within the axial bore, and having a conical recess at one end of the plunger for engaging the cone shaped stop, and having a portion at its other end contoured to be received within said cavity for mounting the plunger to the pusher; and means for biasing the pusher in an upward direction to disengage the movable and stationary contacts with the solenoid coil being deenergized.

* * * * *